US006637620B2

(12) United States Patent
Oshinsky et al.

(10) Patent No.: US 6,637,620 B2
(45) Date of Patent: Oct. 28, 2003

(54) METHOD AND APPARATUS FOR SAMPLING AND ADVERTISING PERFUME

(75) Inventors: Candace Oshinsky, 650 Thomas Ave., Baldwin, NY (US) 11510; Michael Leone, Rockawav, NJ (US); Matthew Maleiko, Oak Ridge, NJ (US); Gerard DeFries, Chatham, NJ (US); Ross Osias, Lincoln Park, NJ (US)

(73) Assignee: Candace Oshinsky, Baldwin, NY (US)

( * ) Notice: Subject to any disclaimer, the term of this patent is extended or adjusted under 35 U.S.C. 154(b) by 63 days.

(21) Appl. No.: 09/865,101

(22) Filed: May 24, 2001

(65) Prior Publication Data

US 2002/0175175 A1 Nov. 28, 2002

(51) Int. Cl.[7] ..... A47F 1/00
(52) U.S. Cl. ..... 221/96; 221/135
(58) Field of Search ..... 221/33, 96, 259, 221/277, 135, 251, 210; 222/321.1, 509

(56) References Cited

U.S. PATENT DOCUMENTS 5,848,727 A * 12/1998 Leo et al. ..... 221/259
2002/0020717 A1 * 2/2002 De Laforcade ..... 222/321.8
2002/0158076 A1 * 10/2002 Snead ..... 221/33

* cited by examiner

*Primary Examiner*—Kenneth W. Noland
(74) *Attorney, Agent, or Firm*—Thomas A. Gallagher

(57) ABSTRACT

An apparatus for sampling perfume includes a card dispenser which includes a built-in atomizer. The dispenser is operated by a simple control which applies a scent onto a card and ejects the card from the dispenser. The dispenser is preferably designed to be resistant to theft. In this regard, the size and appearance of the dispenser may be sufficient to dissuade a shoplifter. Alternatively, the dispenser can be locked to a display counter. According to one of the methods of the invention, the cards dispensed from the dispenser bear advertising indicia indicating the name of the perfume. According to another method of the invention cards are provided with indicia indicating a discount coupon for the perfume purchase.

18 Claims, 5 Drawing Sheets

METHOD AND APPARATUS FOR SAMPLING AND ADVERTISING PERFUME

BACKGROUND OF THE INVENTION

1. Field of the Invention

The invention relates to the advertising and sale of perfume and similar products. More particularly, the invention relates to an apparatus for dispensing a perfume sample onto a discount coupon as well as methods for distributing perfume samples and discount coupons.

2. State of the Art

Perfume is advertised in multiple media and is generally sold at a point of sale counter in a retail store. As used herein, the word perfume includes cologne, eau de toilet, after shave, air freshener and similar scent products which can be dispensed in liquid form. Further, to the extent that a flavor can be sampled by smell, perfume is intended to mean such a flavor.

Although brand name recognition is important to perfume consumers so also is the actual scent of the perfume. More often than not, a perfume consumer will want to sample the scent of the perfume prior to purchasing a quantity of it. Perfume manufacturers have long sought to make sample fragrances available to consumers in order to entice the consumers to purchase a quantity of the perfume.

One type of device used to economically dispense samples of perfume is the sample atomizer. The atomizers are used at a point of sale display to spray a measured amount of the perfume into the air or onto the customer's hand or wrist. One disadvantage of the atomizer is that if it is sprayed into the air it is hard to get a good sample of the scent. However, if it is sprayed on the customer's hand or wrist, the number of different scent samples which can be made is effectively limited to two, one for each hand or wrist. Another disadvantage of the sample atomizers is that they are subject to theft if left unattended. Thus, a salesperson must be present in order for a perfume to be sampled.

Another common means for sampling perfume is the sample card sometimes known as "scratch and sniff" which is distributed in magazines or mailers. Although the "scratch and sniff" cards often fail to accurately reproduce the actual scent of the product, the use of a card is a good idea which has been adopted at point of sale demonstrations. Used in conjunction with sample atomizers, cards are used to sample many different scents at a point of sale display. The method involves the salesperson spraying a scent on an card and handing the card to the customer. The customer can bring the card close to her nose to sample the scent. Many scents can be sampled using different cards. However, as with sample atomizers used alone, a sales person must be present to prevent shrinkage.

SUMMARY OF THE INVENTION

It is therefore an object of the invention to provide methods and apparatus for sampling perfume.

It is also an object of the invention to provide methods and apparatus for sampling perfume which do not require the presence of a sales person.

It is another object of the invention to provide an apparatus for sampling perfume which is resistant to theft.

It is still another object of the invention to provide methods of advertising perfume which can incorporate the methods of sampling perfume according to the invention.

In accord with these objects which will be discussed in detail below, the apparatus of the present invention includes a card dispenser which includes a built-in atomizer. The dispenser is operated by a simple control which dispenses a scent onto a card and ejects the card from the dispenser. The dispenser is preferably designed to be resistant to theft. In this regard, the size and appearance of the dispenser may be sufficient to dissuade a shoplifter. Alternatively, the dispenser can be locked to a display counter. According to the presently preferred embodiment, the cards are coated such that the perfume carried by the card can be applied by the customer to an area of skin. Alternatively, the cards can be absorbent which would allow the customer to sample multiple scents without one scent contaminating another. According to one of the methods of the invention, the cards dispensed from the dispenser bear advertising indicia indicating the name of the perfume. According to another method of the invention cards are provided with indicia indicating a discount coupon for the perfume purchase.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 2:
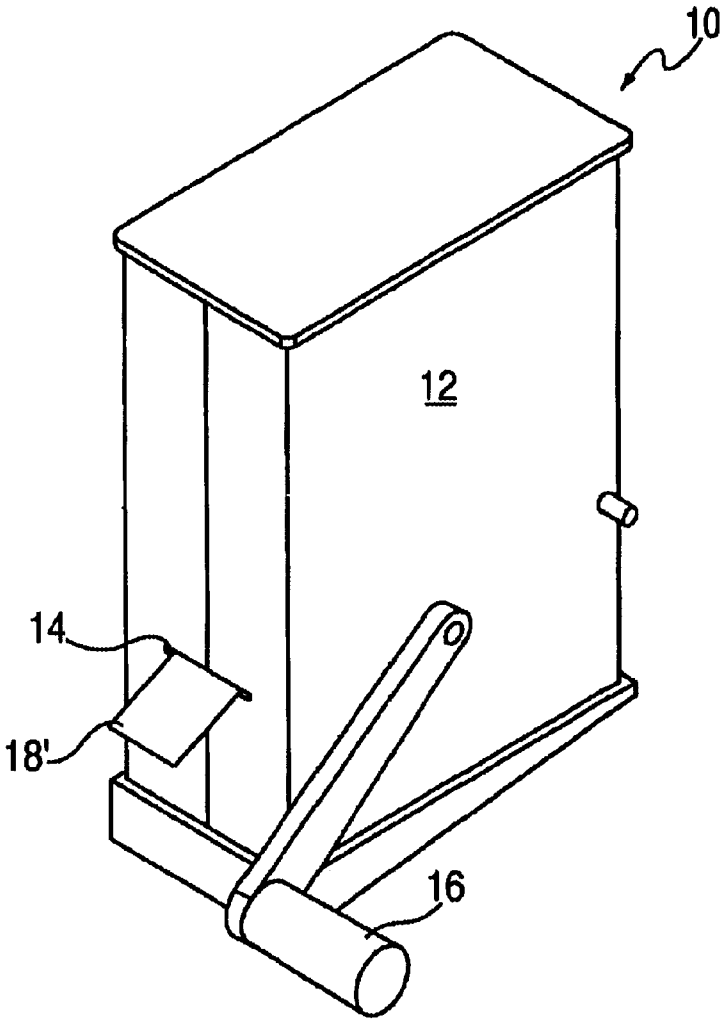
FIG. 2 is a perspective view showing a card being dispensed.
Figure 1:
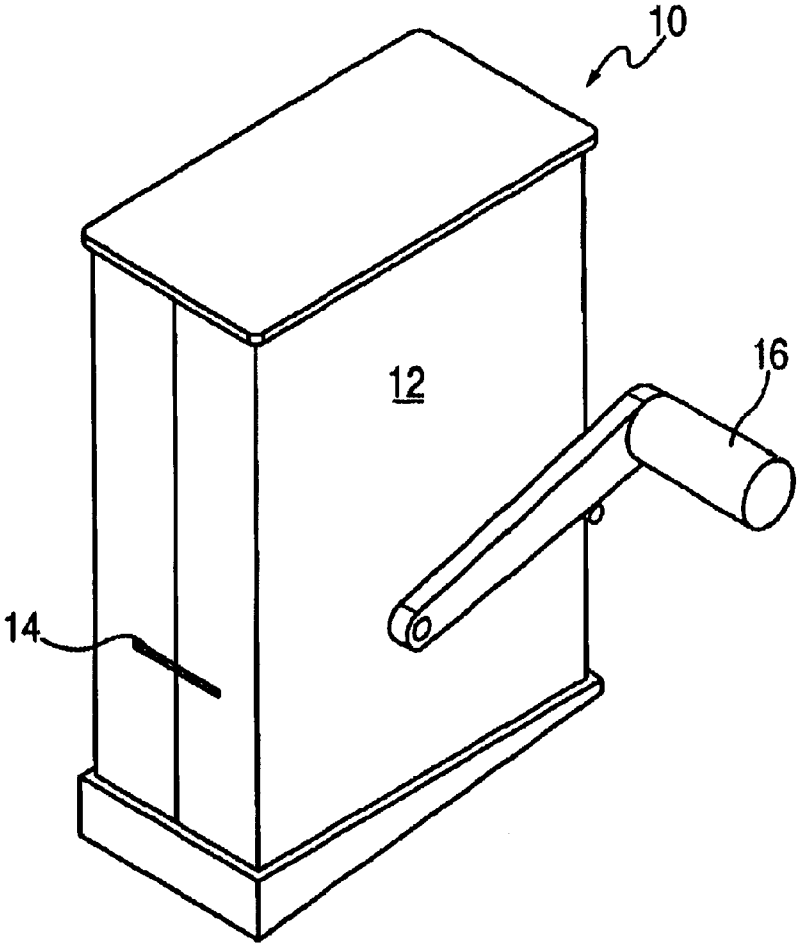
FIG. 1 is a perspective view of a dispenser according to the invention in an idle position.
Figure 3:
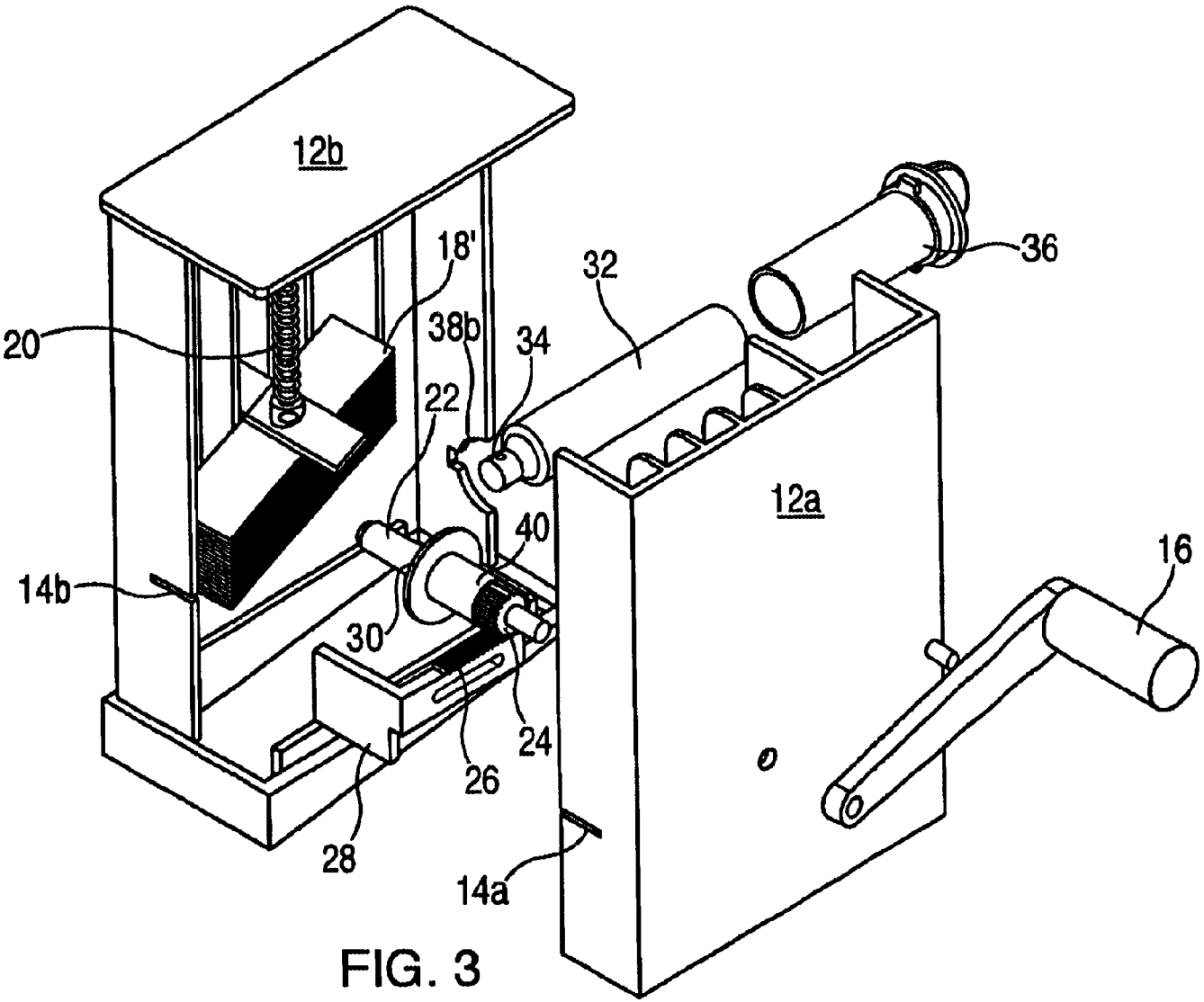
FIG. 3 is an exploded perspective view from the front right.
Figure 4:
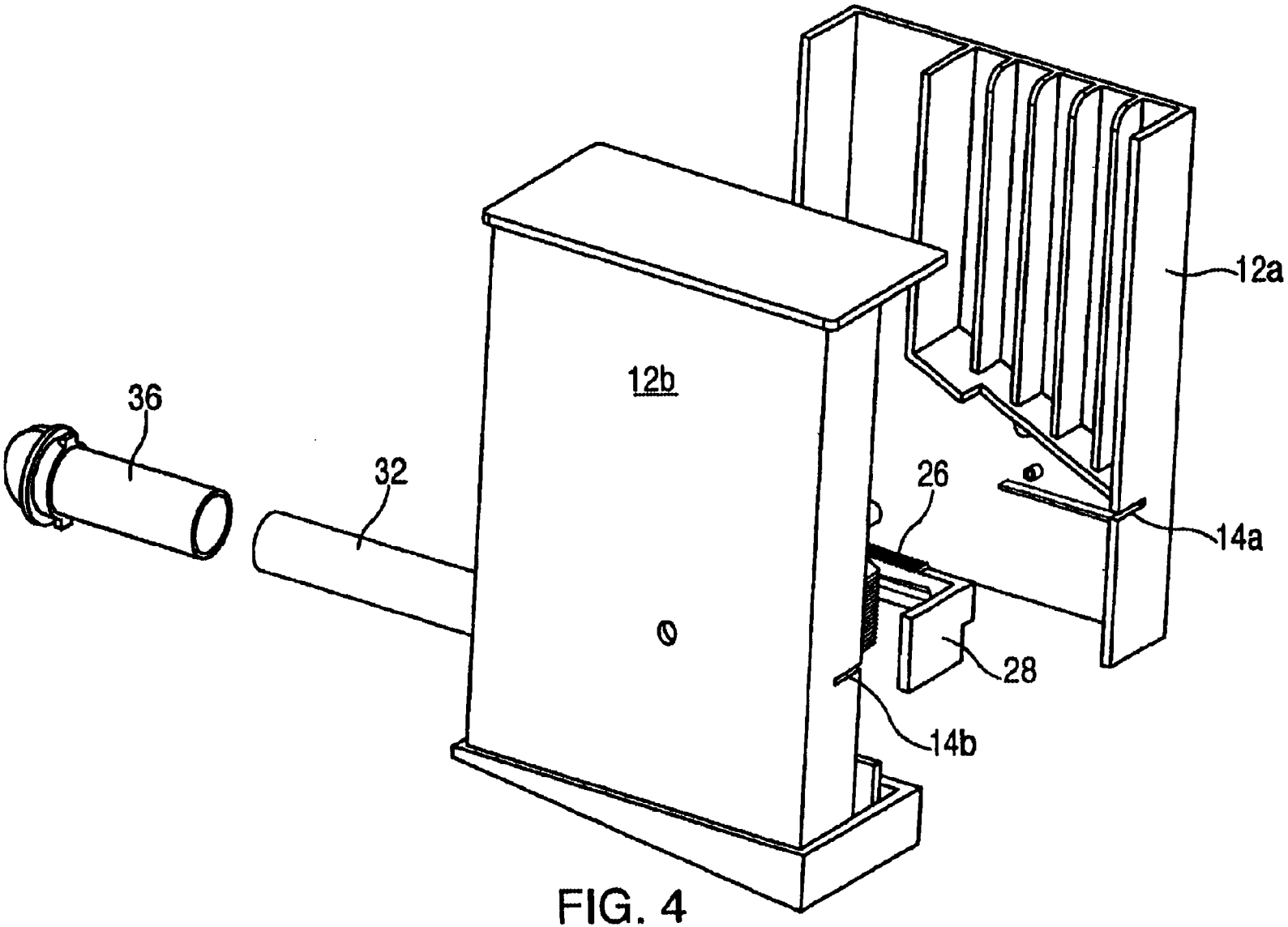
FIG. 4 is an exploded perspective view from the front left.
Figure 5:
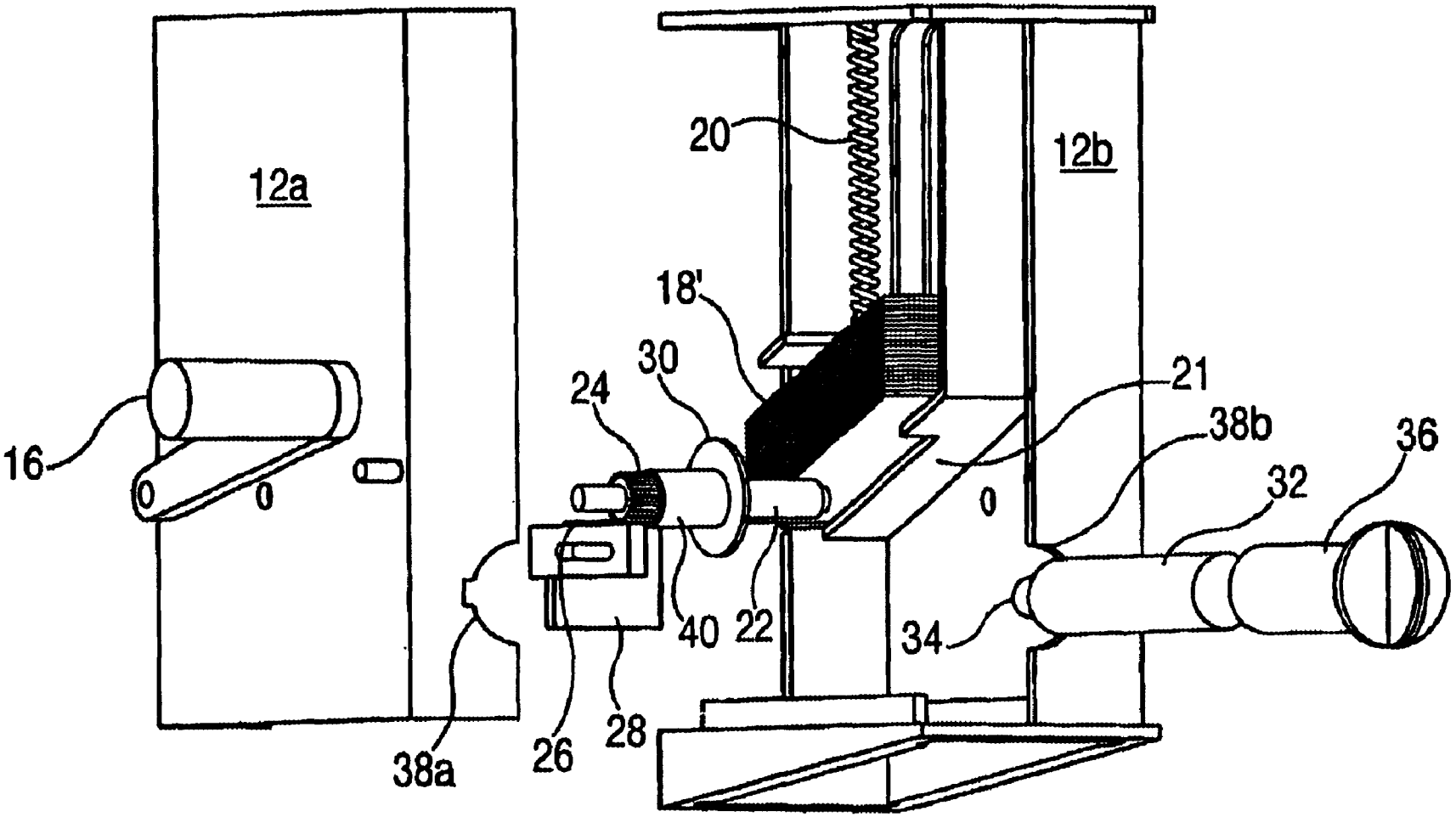
FIG. 5 is an exploded perspective view from the rear.

Referring now to FIGS. 1 through 5, the apparatus 10 includes a housing 12, which according to the presently preferred embodiment is made of two halves 12*a* and 12*b*. The housing defines a dispensing slot 14 (14*a*, 14*b*) and carries an actuator 16, in this embodiment, a lever. When the actuator is moved, a card 18 is dispensed from the slot 14.

Inside the housing 12 are a supply of cards 18' which is biased by a spring 20 toward a guide 21 adjacent to the slot 14. An axle 22, coupled to the actuator 16, is disposed beneath the cards 18'. The axle 22 carries a pinion gear 24 which is arranged to engage a rack member 26 disposed beneath it. The rack member 26 carries a plunger arm 28. The axle 22 also carries a friction wheel 30 which is arranged to engage the bottom card 18 in the stack of cards 18'. An atomizer 32 having a push spray valve 34 is mounted in the housing with the aid of a cylindrical carrier 36 through a keyed hole 38 (38*a*, 38*b*) such that the spray valve 34 lies adjacent to the plunger arm 28 and beneath the bottom card 18. According to the presently preferred embodiment, the cards are coated such that the perfume carried by the card can be applied by the customer to an area of skin. Alternatively, the cards can be absorbent which would allow the customer to sample multiple scents without one scent contaminating another.

The apparatus 10 operates as follows. When the actuator 16 is moved forward, the axle 22 turns. This causes the pinion gear 24 to rotate and move the rack member 26 backwards causing the plunger arm 28 to engage the spray valve 34 causing scent to b sprayed on the bottom card 18.

Simultaneously, the friction wheel 30 engages the card 18 and pushes it out of the slot 14. It will be appreciated that the actuator 16 may be spring biased so that it returns to its initial position after a card is dispensed. It will also be appreciated that when the actuator is returned, it is desirable that the pinion gear return the rack and plunger to their original position. However, it is undesirable for the friction wheel to rotate backwards. To prevent this, a ratchet/clutch member 40 is used to couple the friction wheel 30 to the axle 22.

Figure 6:
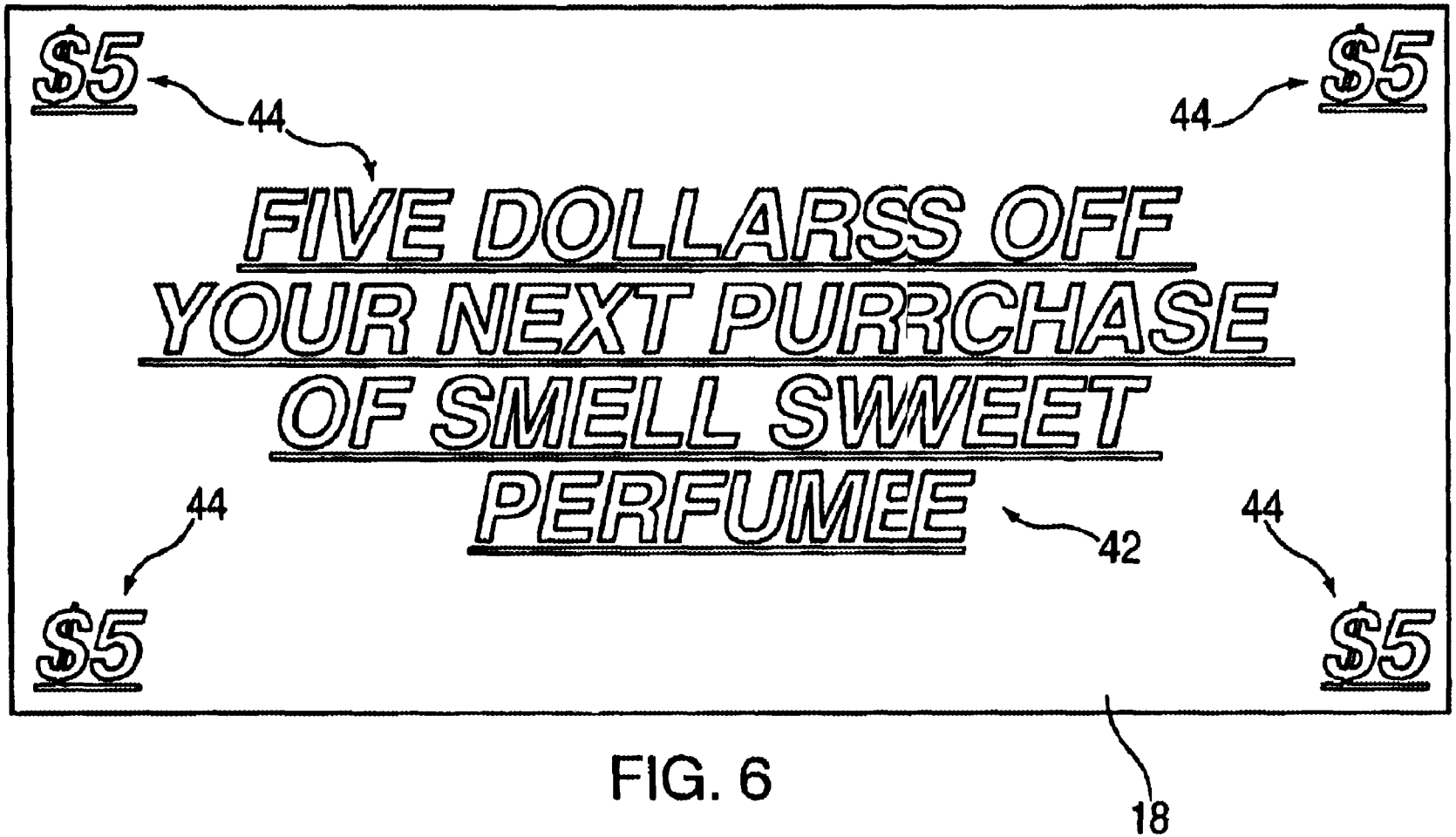
FIG. 6 is an enlarged plan view of a card bearing indicia according to the invention.

Referring now to FIG. 6, according to the methods of the invention, the card 18 carries indicia 42 advertising the brand of perfume and optionally also carries indicia 44 indicating a discount off the purchase of the perfume. Although preferably used in conjunction with the apparatus of the invention, it is believed that the selling method of distributing discount coupons impregnated with a sample scent is new and not obvious.

There have been described and illustrated herein methods and apparatus for sampling and advertising perfume. While particular embodiments of the invention have been described, it is not intended that the invention be limited thereto, as it is intended that the invention be as broad in scope as the art will allow and that the specification be read likewise. Thus, while cards have been shown to be arranged in a stack, it will be appreciated that they could be arranged on a roll with perforations or the apparatus could be provided with a guillotine cutter to separate coupons from the roll. Furthermore, while the apparatus disclosed is manually operated, those skilled in the art will appreciate that it could be modified to be electrically operated. It will be understood that the shape of the housing is a matter of design aesthetics and, as mentioned above, the actuator need not be a lever but could be a knob, a button, or a slider. In addition, while the presently preferred embodiment contemplates a refillable dispenser or at least a dispenser which can be loaded with a selected scent via the keyed opening 38, it is within the scope of the scope of the invention to provide a disposable dispenser which is pre-loaded with a scent which cannot be removed. It will therefore be appreciated by those skilled in the art that yet other modifications could be made to the provided invention without deviating from its spirit and scope as so claimed.

What is claimed is:

1. An apparatus for sampling perfume, said apparatus comprising:

a) means for carrying a supply of cards;

b) means for dispensing the cards, one at a time; and c) means for applying a perfume to the cards, one at a time, prior to dispensing.

2. An apparatus according to claim 1, further comprising:

d) a supply of cards carried in said means for carrying a supply of cards.

3. An apparatus according to claim 1, wherein:

said means for applying includes a perfume atomizer.

4. An apparatus according to claim 1, wherein:

said means for dispensing is coupled to said means for applying such that the perfume is applied to the cards as they are being dispensed.

5. An apparatus according to claim 2, wherein:

said cards each carry advertising indicia.

6. An apparatus according to claim 2, wherein:

said cards each carry discount coupon indicia.

7. An apparatus according to claim 3, wherein:

said perfume atomizer is removable from the apparatus.

8. An apparatus according to claim 4, wherein:

said means for dispensing includes a friction wheel coupled to an axle, and said means for applying includes a pinion gear coupled to said axle, said pinion gear engaging a rack member carrying a plunger arm.

9. An apparatus according to claim 8, further comprising:

d) actuator means coupled to said axle for causing said axle to rotate.

10. An apparatus according to claim 2, wherein:

said cards are coated such that a perfume sample applied to a card can be transferred to the skin.

11. An apparatus according to claim 2, wherein:

said cards are absorment.

12. An apparatus for sampling perfume, said apparatus comprising:

a) a housing carrying a supply of cards;

b) means for dispensing said cards from said housing one at a time, wherein said cards are coated such that a perfume sample applied to a card can be transferred to the skin, and said cards, when dispensed, carry a perfume scent.

13. An apparatus according to claim 12, wherein:

each card is applied with perfume at the time it is dispensed.

14. An apparatus for sampling perfume, said apparatus comprising:

a) a housing carrying a supply of cards;

b) means for dispensing said cards from said housing one at a time, wherein said cards, when dispensed, carry a perfume sample which can be transferred to the skin.

15. An apparatus according to claim 14, wherein:

said perfume sample includes a liquid droplet carried on the surface of the dispensed card.

16. An apparatus according to claim 14, further comprising:

c) means for applying perfume to the cards prior to dispensing the cards.

17. An apparatus according to claim 14, wherein:

at least one of said cards bears advertising indicia.

18. An apparatus according to claim 14, wherein:

at least one of said cards bears discount coupon indicia.

* * * * *